US006206221B1

(12) United States Patent
Bando et al.

(10) Patent No.: US 6,206,221 B1
(45) Date of Patent: Mar. 27, 2001

(54) COVERING DEVICE

(75) Inventors: Takeshi Bando; Yoshikazu Tanaka, both of Kanonji; Norikazu Shinogi, Shinjuku-Ku, all of (JP)

(73) Assignees: Uni-Charm Corporation; Dai Nippon Printing Co., Ltd., both of (JP)

( * ) Notice: Subject to any disclaimer, the term of this patent is extended or adjusted under 35 U.S.C. 154(b) by 0 days.

(21) Appl. No.: 09/297,823

(22) PCT Filed: Sep. 4, 1998

(86) PCT No.: PCT/JP98/03964

§ 371 Date: May 10, 1999

§ 102(e) Date: May 10, 1999

(87) PCT Pub. No.: WO99/12823

PCT Pub. Date: Mar. 18, 1999

(30) Foreign Application Priority Data

Sep. 8, 1997 (JP) ..... 9-243035
Sep. 8, 1997 (JP) ..... 9-243041
Sep. 8, 1997 (JP) ..... 9-243046

(51) Int. Cl.[7] ..... B65D 39/00

(52) U.S. Cl. ..... 220/254; 220/326; 220/829; 220/833; 220/835; 220/836

(58) Field of Search ..... 220/827, 829, 220/833, 835, 836, 838, 254, 326

(56) References Cited

U.S. PATENT DOCUMENTS 4,739,900 * 4/1988 Borst ..... 220/339
4,874,103 * 10/1989 Quisenberry et al. ..... 220/254
5,573,132 * 11/1996 Kanfer et al. ..... 220/4.23
5,620,107 * 4/1997 Takeuchi ..... 215/235

FOREIGN PATENT DOCUMENTS 60-161926 10/1985 (JP) .
9-58725 3/1997 (JP) .

* cited by examiner

*Primary Examiner*—Stephen K. Cronin

(57) ABSTRACT

A lid assembly (20) comprises a lid body (21) having an dispensing opening and fitted on a container body (11), and a hinged lid (23) pivotally joined to the lid body (21). A rubber plate (50) is extended across a hinged joint between the lid body (21) and the hinged lid (23). The lid body (21) is provided with a recess (60), and a vertical plate (92) and a horizontal plate (90) are formed in the recess (60). The vertical plate (92) is provided with a catching projection (79) that catches a stopping projection (23) formed on the hinged lid (23).

13 Claims, 11 Drawing Sheets

COVERING DEVICE

TECHNICAL FIELD

The present invention relates to a lid assembly for hermetically closing an opening in a container body, particularly to a lid assembly that can be opened by a single touch thereto.

BACKGROUND ART

A container body containing articles, such as wet tissues has a lid assembly for opening and hermetically closing the container body.

Such lid assembly is attached to the container body, and comprises a lid body with a hinged lid joined to the lid body and able to move freely.

In order to pull out the wet tissues, the hinged lid is lifted up from the lid body thereby exposing the dispensing opening. The wet tissues can then be taken out one at a time.

As mentioned above, the lid assembly comprises the lid body, and the hinged lid joined to the lid body, which must be lifted up to expose the dispensing opening every time the tissues are taken out.

It would be convenient if the hinged lid could be opened with a single touch thereto.

DISCLOSURE OF THE INVENTION

Accordingly, one of the objects of the present invention is to provide a lid assembly having a hinged lid that can be opened easily and safely.

The present invention provides a lid assembly comprising:

a lid body having an outer frame to be fitted on a container body which is provided with a dispensing opening; and a hinged lid pivotally joined to the lid body so as to close the dispensing opening hermetically. A hinged joint between the lid body and the hinged lid is provided with an elastic biasing means for biasing the hinged lid in an opening direction, the outer frame provided with a vertical plate and a horizontal plate on part of the edge of the free side of the hinged lid, the hinged lid is provided with a stopping projection on the free edge of the hinged lid, the vertical plate provided with a catching projection that catches the stopping projection of the hinged lid, and which can be disengaged from the stopping projection by pressing the horizontal plate to bend the vertical plate.

In this lid assembly, a recess sunk beneath the outer surface of the outer frame may be formed in a part of the outer frame on the free end of the hinged lid; the vertical plate may be formed in the recess so as to be separated from the outer frame; and the horizontal plate may be extended from the vertical plate in a direction away from the hinged lid.

In this lid assembly, a top plate sunk beneath the outer surface of the outer frame may be connected to the outer frame by a vertical wall, the dispensing opening may be formed in the top plate, the horizontal plate and the vertical plate may be formed by forming slits in parts of the outer frame and the vertical wall on the free side of the hinged lid, and the horizontal plate and the vertical plate may be separated from the other parts of the outer frame and the vertical wall by the slits.

In this lid assembly, a top plate sunk beneath the outer surface of the outer frame may be connected to the outer frame by a vertical wall. The dispensing opening may be formed in the top plate, the horizontal plate and the vertical plate may be formed by forming thin parts in parts of the outer frame and the vertical wall on the free side of the hinged lid, and the horizontal plate and the vertical plate may be separated from the other parts of the outer frame and the vertical wall by the thin parts.

According to the present invention, the vertical plate can be bent to release the stopping projection from the catching projection by pressing the horizontal plate without bending the outer frame, and then the hinged lid is opened by the elastic biasing means.

BRIEF DESCRIPTION OF THE DRAWINGS

FIG. 4(*b*) is a diagrammatic view indicating how the wet tissues are folded;

BEST MODE FOR CARRYING OUT THE INVENTION

First Embodiment

Preferred embodiments of the present invention will be described with reference to the accompanying drawings. FIGS. 1 to 4 illustrate a lid assembly in a first embodiment of the present invention.

Figure 1:
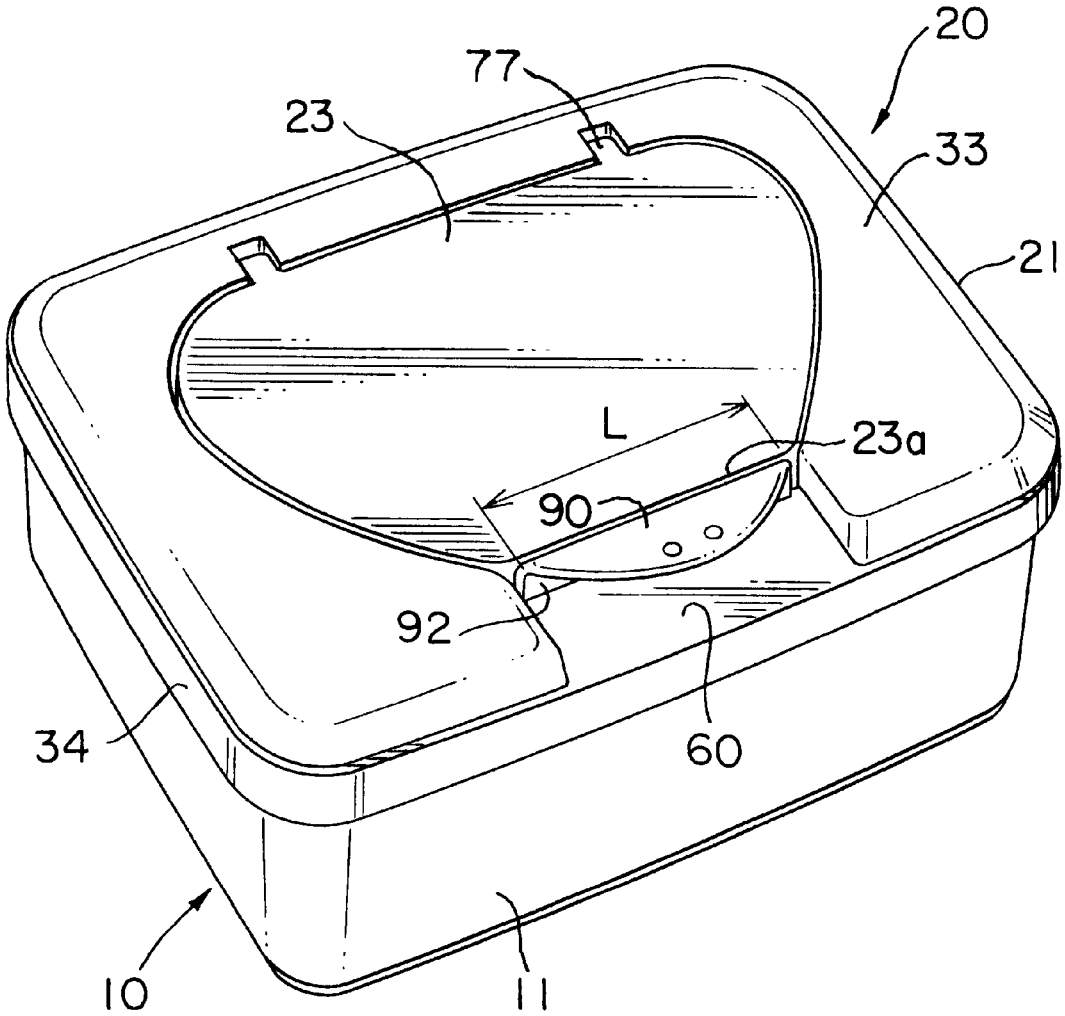
FIG. 1 is a perspective view of a wet tissue container provided with a lid assembly as described in a first embodiment of the present invention.
Figure 2:
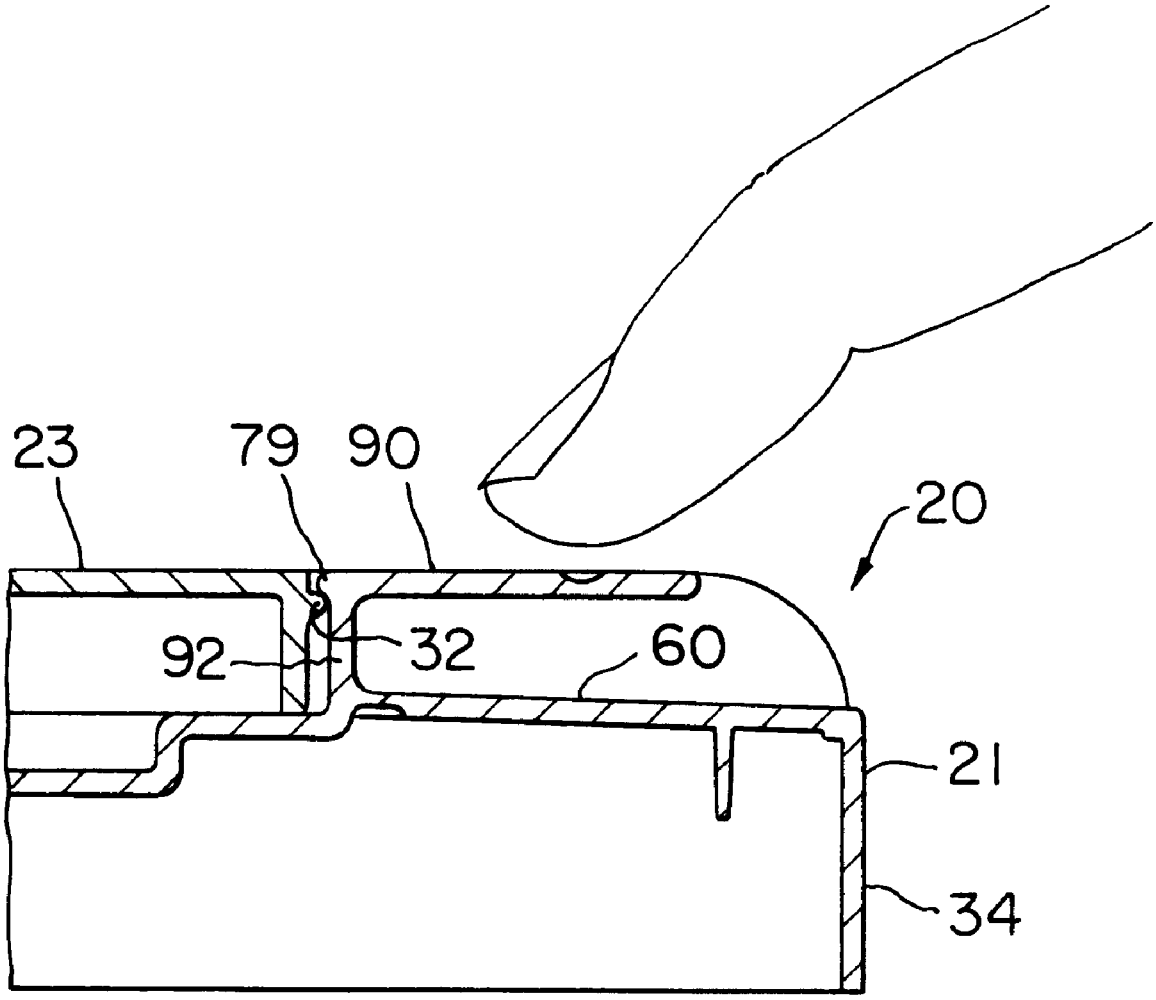
FIG. 2 is an enlarged sectional view indicating the operation for opening a hinged lid.
Figure 3:
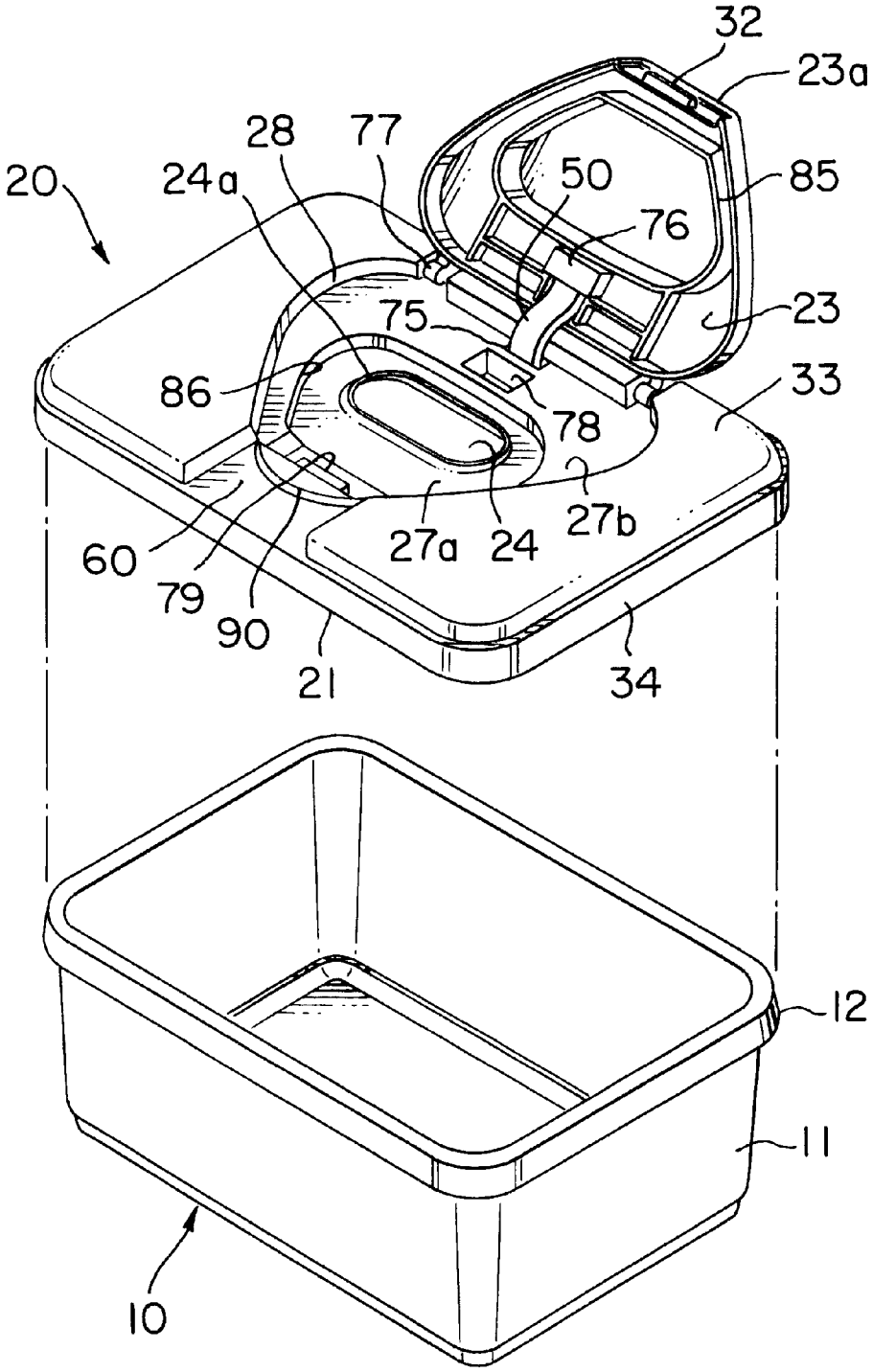
FIG. 3 is a perspective view of a wet tissue container with the hinged lid opened.
Figure 4A:
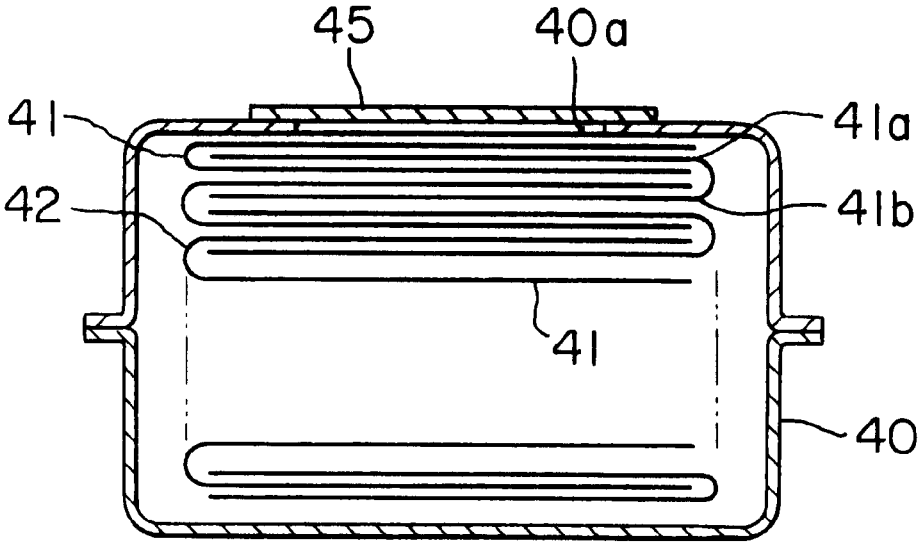
FIG. 4(*a*) is a sectional view of a sealed pouch containing wet tissues.
Figure 4B:
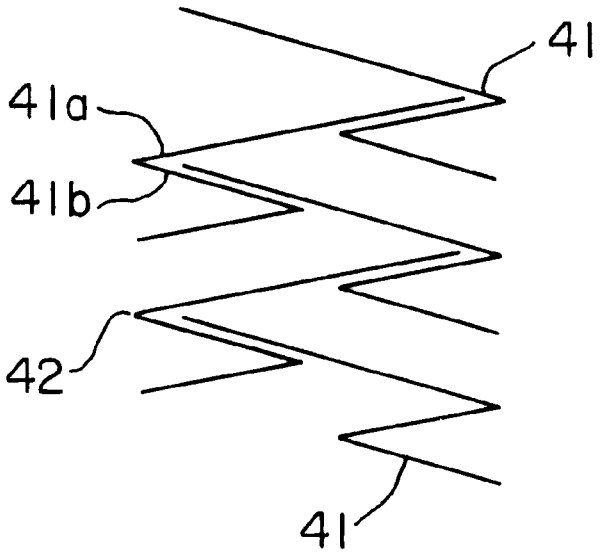

Referring to FIGS. 1 to 4(*b*), a wet tissue container 10 comprises a container body 11 for containing wet tissues 41 (FIGS. 4(*a*) and 4(*b*)), for dispensing tissues from the top side and a lid assembly 20 fitted on the container body 11. A flange 12 is formed around an open edge of the container body 11. The flange 12 fits into the rim 34 formed in the lid assembly 20.

The lid assembly 20 includes a lid body 21 which hermetically closes over the open end of the container body 11, and a hinged lid 23 pivotally connected to the lid body 21 by hinge pins 77. The hinge pins 77 are formed integrally with the hinged lid 23 and are fitted into receptors (not shown) formed within the lid body 21 thereby allowing the hinged lid 23 to move freely against the lid body 21 (FIG. 3).

The lid body 21 has a first top plate (first thin plate) 27*a* near the central part thereof, a second top plate (second thin plate) 27*b* surrounding the first top plate 27*a*. A vertical wall 28 surrounds the second top plate 27*b*, and an outer frame 33 extends around the vertical wall 28. The first top plate 27*a* is provided with a dispensing opening 24 through which the wet tissues 41 are pulled out. The dispensing opening 24 is surrounded by a rim 24*a* having a curved cross section expanding downward. This allows the wet tissues 41 to be pulled out through the dispensing opening 24 without catching on the rim 24*a* of the dispensing opening 24. The rim 34 which fits on the flange 12 of the container body 11 is formed around the circumference of the outer frame 33.

A rib 85 is formed on the inner surface of the hinged lid 23. The rib 85 fits within the space defined by the vertical wall 86 formed between the first top plate 27*a* and the second top plate 27*b*. The hinged lid 23 is pivoted on the hinge pins 77 so that the rib 85 fits within the space defined by the vertical wall 86, thereby sealing the dispensing opening 24.

As shown in FIGS. 2 and 3, a stopping projection 32 is formed on the free end of the hinged lid 23.

A recess 60 sunk below the outer frame 33 of the lid body 21 is formed in a section of the outer frame 33 on the non-hinged side (free end part) of the hinged lid 23. A vertical plate 92 extends from the recess 60 on the free end side of the hinged lid 23. A horizontal plate 90 is attached to the upper end of the vertical plate 92, extending in a direction away from the hinged lid 23. The width L of the vertical plate 92 is equal to that of the recess 60 and equal to the width of the edge 23*a* of the free end side of the hinged lid 23.

The vertical plate 92 and the horizontal plate 90 are separate from the outer frame 33. The vertical plate 92 is provided with a catching projection 79 on the surface facing the hinged lid 23. The catching projection 79 engages with the stopping projection 32 on the hinged lid 23.

As shown in FIG. 3, an elongated rubber plate 50 for biasing the hinged lid 23 in an opening direction is extended across the axis of the hinge pins 77. An opening 75 for housing one end of the rubber plate is formed in the lid body 21, and a rubber plate holding part 76 for fixedly holding one end of the rubber plate is formed in the hinged lid 23 at a certain distance from the lid body 21.

As shown in FIG. 3, an opening 78 is formed in a part of the lid body 21 near the opening 75 to house the section of rubber plate 50 that folds over when the hinged lid 23 is closed.

As the hinged lid 23 is pushed into a closed position, the rubber plate 50 bends away from the hinge pins 77 and exerts a force in the opening direction on the hinged lid 23. The curved rubber plate 50 can be smoothly received by the opening 78. This means that the rubber plate 50 will not be damaged or pinched between the lid body 21 and the hinged lid 23 or be damaged when the hinged lid 23 is closed.

Although the lid assembly 20 shown in FIG. 3 is provided with only the one rubber plate 50, the lid assembly 20 may be provided with a plurality of rubber plates.

The container body 11 and the lid assembly 20 of the wet tissue container 10 are formed of a polypropylene resin (PP) by injection molding. Other materials that may be used for forming container body 11 and the lid assembly 20 are PE resins, ABS resins, elastomers, PET resins PVC resins and polycarbonate resins.

The following describes how the wet tissues 41 are contained in the container body 11 with reference to FIGS. 4(*a*) and 4(*b*). As shown in FIG. 4(*a*), the folded wet tissues 41 are stacked and sealed in a sealed pouch 40 mode of a flexible sheeting. Each wet tissue is folded twice to form a fold lien 42. The folded lower half 41*b* of the first top wet tissue 41 is sandwiched between the upper half 41*a* of the second (following) wet tissue 41 (which lies under the first wet tissue 41) and the upper half 41*a* of a third wet tissue 41 (which lies under the following wet tissue 41) (See FIG. 4(*b*)). Thus, when the top wet tissue 41 is pulled out, the lower half 41*b* of the top wet tissue 41 pulls up the upper half 41*a* of the second wet tissue 41. There are no particular restrictions on the manner of folding wet tissues 41; the only requirement is that they are stacked so that they can be taken out continuously. For example, the wet tissues 41 may be folded as shown in FIG. 4(*b*). An opening 40*a* is formed in the upper surface of the sealed pouch 40. This opening 40*a* is closed hermetically with a covering sheet 45 detachably attached to the upper surface of the sealed pouch 40.

The wet tissues 41 are made from a fibrous material, such as nonwoven fabric, paper or a gauze, a foam sheet or a paper-based soft material. The wet tissues 41 may be impregnated with a liquid, such as a wetting material containing a sterilizer, a disinfectant, a detergent, or a lotion.

The following describes an operation of the lid assembly in this embodiment of the invention.

One end of the rubber plate 50 is inserted into the opening 75 of the lid body 21, and the other end is fixed to the rubber plate holding part 76 of the hinged lid 23.

The sealed pouch 40 hermetically containing the wet tissues 41 is put in the container body 11, and the rim 34 of the lid assembly 20 is fitted over the flange 12 of the container body 11 thereby closing the open end of the container body 11 hermetically with the lid assembly 20. Next, the hinged lid 23 of the lid assembly 20 is pushed shut and the stopping projection 32 is engaged with the catching projection 79, thereby closing the dispensing opening 24 in the lid body 21 hermetically. At this point, the rubber plate 50 bends away from the common axis of the hinge pins 77 and biases the hinged lid 23 in the opening direction.

As shown in FIG. 3, the rubber plate 50 exerts a force on the rubber plate holding part 76 at a short distance inside from the hinge of the hinged lid 23. This is because the rubber plate 50 is fixed to the rubber plate holding part 76 formed at a certain distance from the lid body 21. Generally, the wet tissue container 10 would be used in an environment with relatively high temperatures, such as in a room in summer. This use may cause the lid body 21 or the hinged lid 23 to become soft. According to the present invention, the hinge end of the hinged lid 23 is less deformed when the point of action of the force of the rubber plate 50 on the hinged lid 23 is at a short distance from the hinge than when the point of action of the force of the rubber plate 50 is on the pivot of the hinged lid 23.

When opening the hinged lid 23, the horizontal plate 90 is depressed which bends back the vertical plate 92, thereby releasing the stopping projection from the catching projection 79. As a result, the hinged lid 23 pivots on the hinge pins 77 and is pushed open by the rubber plate 50.

Next, the top wet tissue 41 is pulled upwards. The lower half 41*b* of the top wet tissue 41 pulls on the upper half 41*a* of the second top wet tissue. As the top wet tissue 41 is pulled further, the upper half 41*a* of the second top tissue 41 catches on the rim 24*a* of the dispensing opening 24 and separates from the lower half 41*b* of the top wet tissue 41.

In this embodiment, the vertical plate 92 is bent backwards when the horizontal plate 90 is depressed, so that the catching projection 79 is disengaged from the stopping projection 32 on the hinged lid 23 with a high degree of reliability.

According to the present invention, the vertical plate is bent when the horizontal plate is depressed, so that the catching projection is disengaged from the stopping projection of the hinged lid with a high degree of reliability. This means that the articles in the container can be taken out with a high degree of reliability.

Second Embodiment

The following describes a second embodiment of the present invention with reference to FIGS. 5 to 11.

Figure 5:
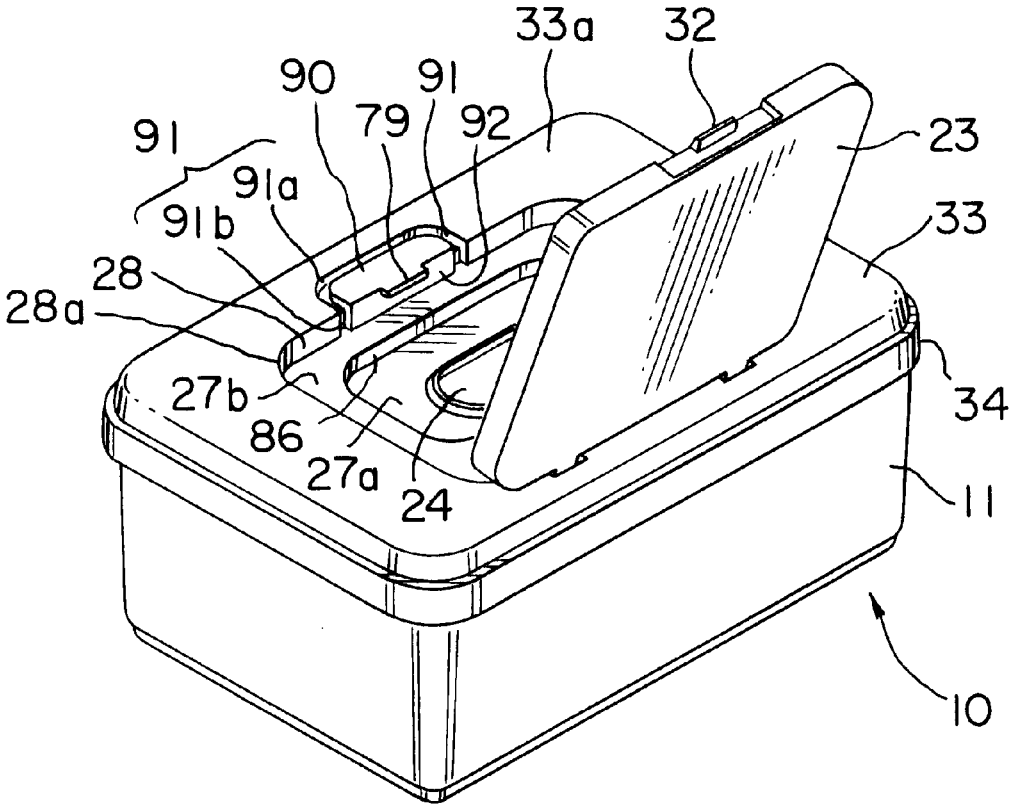
FIG. 5 is a perspective view of a wet tissue container provided with a lid assembly in a second embodiment of the present invention.
Figure 6:
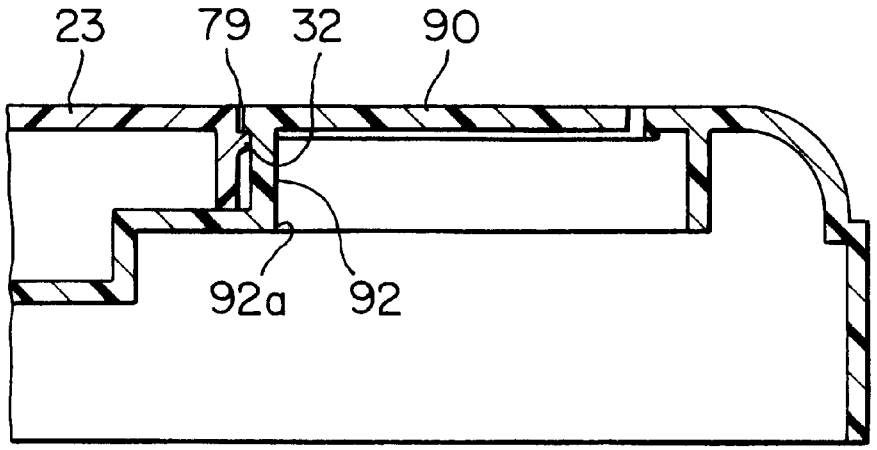
FIG. 6 is an enlarged sectional view indicating the operation for opening the hinged lid.
Figure 7:
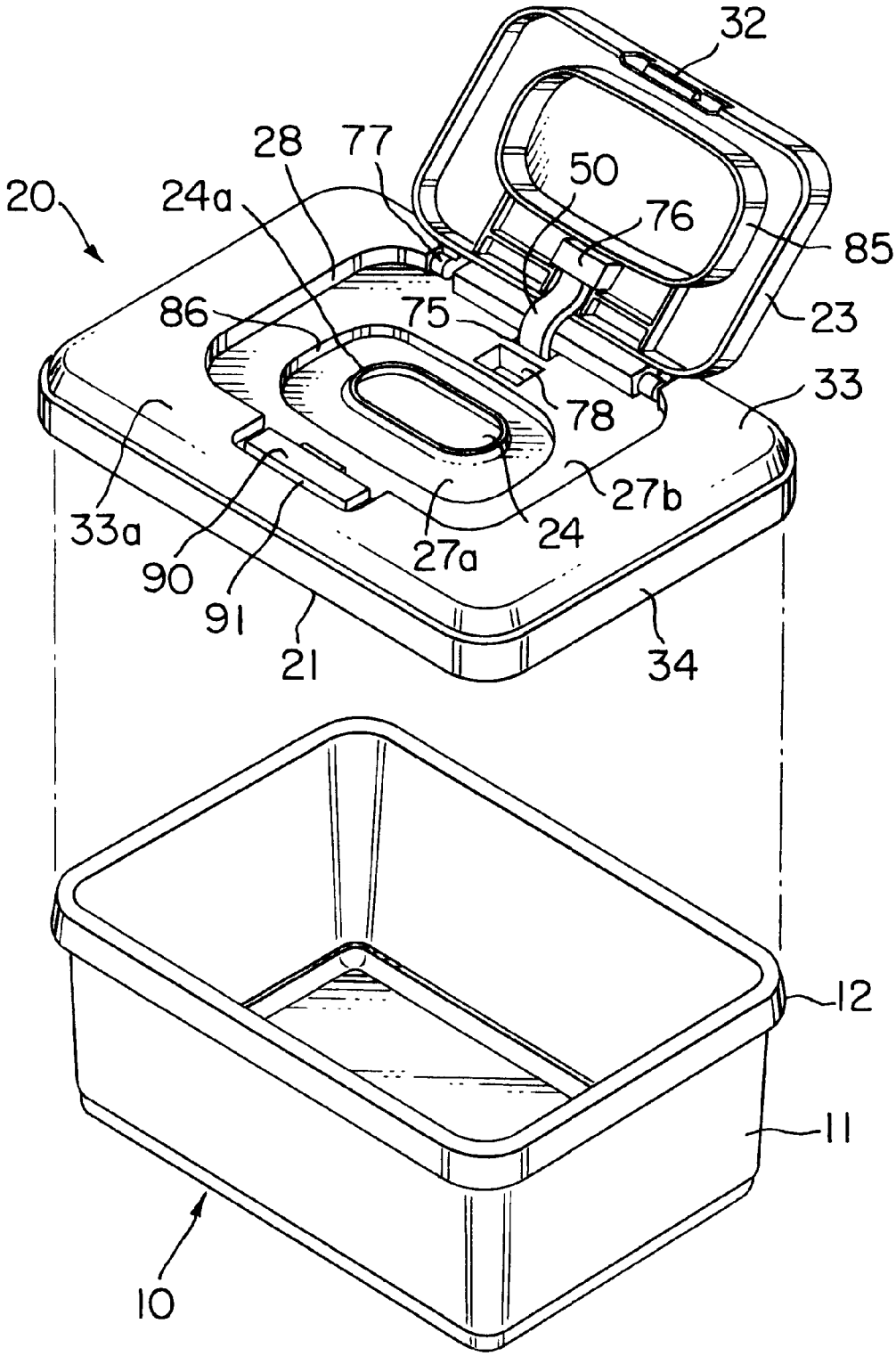
FIG. 7 is a perspective view of a wet tissue container with the hinged lid open.

Referring to FIGS. 5 to 7, a wet tissue container 10 comprises a container body 11 for containing wet tissues 41 (FIGS. 4(*a*) and 4(*b*)), having an open upper end, and a lid assembly 20 fitted on the container body 11. A flange 12 is formed around the edge of the open end of the container body 11. The flange 12 fits into a rim 34 formed around the lid assembly 20.

The lid assembly 20 includes a lid body 21 which hermetically closes over the open upper end of the container body 11, and a hinged lid 23 pivotally connected to the lid body 21 by hinge pins 77. The hinge pins 77 are formed integrally with the hinged lid 23 and are fitted into receptors, (not shown) formed within the lid body 21 thereby allowing the lid 23 to move freely against the lid body 21 (FIG. 7).

The lid body 21 has a first top plate (first thin plate) 27*a* near the central part thereof, a second top plate (second thin plate) 27*b* surround the first top plate 27*a*. A vertical wall 28 surrounds the second top plate 27*b*, and an outer frame 33 extends around the vertical wall 28. Thus, the first top plate 27*a* and the second top plate 27*b* lie below the surface of the outer frame 33 by a depth corresponding to the height of the vertical wall 28. The first top plate 27*a* is provided with an dispensing opening 24 through which the wet tissues 41 are pulled out. The dispensing opening 24 is surrounded by a rim 24*a* having a curved cross section expanding downward. This allows the wet tissue 41 to be pulled out through the dispensing opening 24 without catching on by the rim 24*a* of the dispensing opening 24. A rim 34 which fits over the flange 12 of the container body 11 is formed around the circumference of the outer frame 33.

A rib 85 is formed on the inner surface of the hinged lid 23. The rib 85 fits within the a space defined by a vertical wall 86 formed between the first top plate 27*a* and the second top plate 27*b*. The hinged lid 23 is pivoted on the hinge pins 77 so that the rib 85 fits within the space defined by the vertical wall 86, thereby sealing the dispensing opening 24.

As shown in FIGS. 6 and 7, a stopping projection 32 is formed on the free end of the hinged lid 23.

A slit 91 is formed in the outer frame 33 and the vertical wall 28 of the lid body 21 at a position corresponding to the free end of the hinged lid 23 thereby forming a horizontal plate 90 and a vertical plate 92 separate from the other parts in the outer frame 33 and the vertical wall 28. The slit 91 has a U-shaped slit 91*a* formed in the outer frame 33, and a pair of straight, vertical slits 91*b* formed in the vertical wall 28. The U-shaped slit 91*a* completely separates the horizontal plate 90 from the other part 33*a* of the outer frame 33, and the vertical slits 91*b* completely separates the vertical plate 92 from the other part 28*a* of the vertical wall 28.

The horizontal plate 90 extends across the upper end of the vertical plate 92 in a direction away from the hinged lid 23. The horizontal plate 90 and the vertical plate 92 are separate from the other parts 33*a* and 28*a* of the outer frame 33 and the vertical wall 28.

The vertical plate 92 is provided with a catching projection 79 on its surface facing the hinged lid 23. This projection 79 engages with the stopping projection 32 of the hinged lid 23.

The horizontal plate 90 and the vertical plate 92 are flexible. When the horizontal plate 90 is pressed the vertical plate 92 bends on its lower end 92*a*, thereby disengaging the stopping projection 32 of the hinged lid 23 from the catching projection 79 of the vertical plate 92.

As shown in FIG. 7, an elongated rubber plate 50 for biasing the hinged lid 23 in an opening direction is extended across the axis of the hinge pins 77 supporting the hinged lid 23 on the lid body 21. An opening 75 for receiving one end of the rubber plate 50 is formed in the lid body 21, and a rubber plate holding part 76 for attaching the other end part of the rubber plate 50 is formed in the hinged lid 23 at a predetermined distance from the lid body 21.

As shown in FIG. 7, an opening 78 is formed in a part of the lid body 21 near the opening 75 to house the rubber plate 50 that folds when the hinged lid 23 is closed.

When the hinged lid 23 is pushed shut, the rubber plate 50 bends away from the pivot pins 77 and exerts a force in an opening direction on the hinged lid 23. At this point, the rubber plate 50 curls up and smoothly fits in the opening 78. This means that the rubber plate 50 is not pinched between the lid body 21 and the hinged lid 23 or damaged when the hinged lid 23 is closed.

Although the lid assembly 20 shown in FIG. 7 is provided with only the one rubber plate 50, the lid assembly 20 may be provided with a plurality of these.

An operation of the lid assembly in this embodiment will be described below.

One end of the rubber plate 50 is inserted in the opening 75 of the lid body 21, and the other end is fixed to the rubber plate holding part 76 of the hinged lid 23.

A sealed pouch 40 hermetically containing wet tissues 41 is put into the container body 11, and the rim 34 of the lid assembly 20 is fitted over the flange 12 of the container body 11, thereby sealing the end of the container body 11. The hinged lid 23 of the lid assembly 20 is then pushed shut on the lid body 21 so that the stopping projection 32 is engaged with the catching projection 79, thereby sealing the dispensing opening 24 of the lid body. In this position, the rubber plate 50 bends away from the common axis of the hinge pins 77 and biases the hinged lid 23 in the opening direction.

Since the rubber plate 50 is fixed to the rubber plate holding part 76 formed at a certain distance from the lid body 21 as shown in FIG. 7, the rubber plate 50 exerts a force on the rubber plate holding part 76 at a short distance inside from the hinge of the hinged lid 23 and this pushes the hinged lid 23 in the opening direction. Generally, the wet tissue container 10 is used in an environment of relatively high temperatures, such as in a room in summer. This use means that, the lid body 21 and the hinged lid 23 are liable to be softened. According to the present invention, the turning end of th hinged lid 23 is less likely to be formed when the point of force of the rubber plate 50 on the hinged lid 23 is at a short distance from the hinge of the hinged lid 23 than when the point of force of the rubber plate 50 is on the turning end of the hinged lid 23.

When using the wet tissues 41, the horizontal plate 90 is depressed to bend the vertical plate 92 on its lower end 92*a* so that the stopping projection 32 is released from the catching projection 79 without distorting the outer frame 33. Consequently, the hinged lid 23 is turned on the hinge pins 77 in the opening direction by the resilience of the rubber plate 50.

The top wet tissue 41 is the pulled out from the container body 11. The lower half 41*b* of the top wet tissue 41 pulls on the upper half 41*a* of the second top wet tissue. As the top wet tissue 41 is pulled further, the upper half 41*a* of the second top wet tissue 41 catches on the rim 24*a* of the dispensing opening 24 and is separated from the lower half 41*b* of the top wet tissue 41.

In this embodiment, the vertical plate 92 connected to the horizontal plate 90 is bent by depressing the horizontal plate 90, whereby the catching projection 79 of the vertical plate 92 is disengaged from the stopping projection 32 on the hinged lid 23 with a high degree of reliability.

Figure 8:
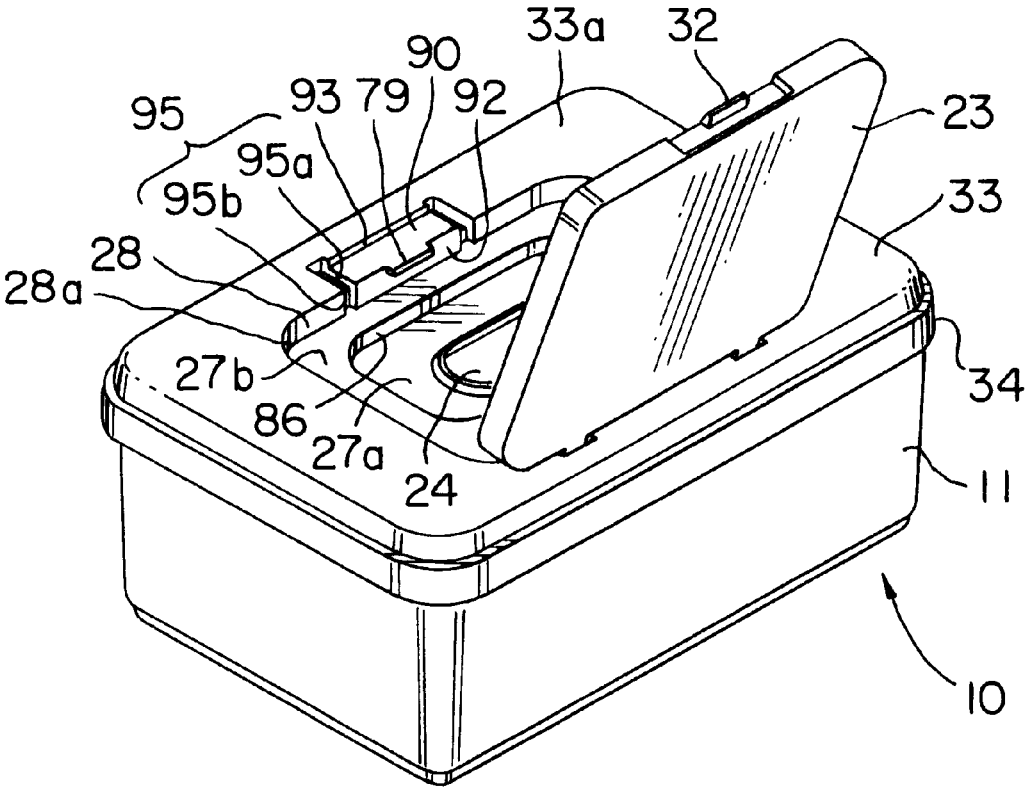
FIG. 8 is a perspective view of a modification of the present invention.
Figure 9:
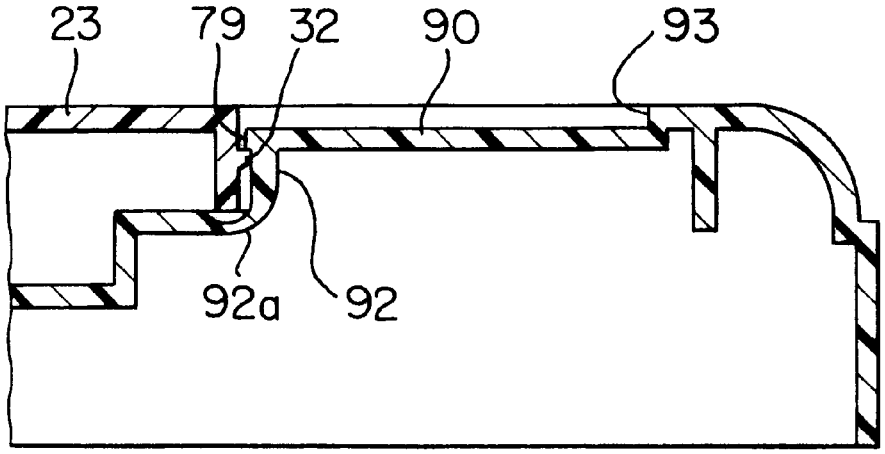
FIG. 9 is a sectional view of the modification shown in FIG. 8.

A modification of the lid assembly will now be described with reference to FIGS. 8 and 9. The modified lid assembly shown in FIGS. 8 and 9 is provided with a pair of slits 95 formed in parts of the outer frame 33 and the vertical wall 28 on the free end of the hinged lid 23, each slit 95 having a horizontal slit 95*a* and a vertical slit 95*b*. The lid assembly shown in FIGS. 8 and 9 is substantially the same in other respects as the embodiment shown in FIGS. 5 to 7.

In FIGS. 8 and 9, parts like or corresponding to those of the embodiment shown in FIGS. 5 to 7 are designated by the same reference characters and the description thereof will be omitted.

Referring to FIGS. 8 and 9, the pair of slits 95 are formed in the outer frame 33 and the vertical wall 28. Each slit 95 has the linear, horizontal slit 95*a* formed in the outer frame 33 and a linear, vertical slit 95*b* formed in the vertical wall 28. The horizontal slits 95*a* of the pair of slits 95 separate the horizontal plate 90 from the other part 33*a* of the outer frame 33, and the vertical slits 95*b* separate a vertical plate 92 from the other part 28*a* of the vertical wall 28.

The horizontal plate 90 is connected to the outer frame 33 by a linear connecting part 93 and is sunk slightly beneath the outer surface of the outer frame 33. The vertical plate 92 is completely separate from the other part 28*a* of the vertical wall 28.

When the horizontal plate is pressed, as viewed in FIGS. 8 and 9, the vertical plate 92 connected to the horizontal plate 90 bends on its lower end 92*a*, so that the stopping projection 32 is released from the catching projection 79.

Another modification of the lid assembly will now be described with reference to FIGS. 10 and 11. In the lid assembly in this modification shown in FIGS. 10 and 11, a vertical plate 92 has a thin part 97 formed by reducing the thickness of a lower end thereof (the part between the vertical plate 92 and a second top plate 27*b*). The lid assembly shown in FIGS. 10 and 11 is substantially the same in other respects as that shown in FIGS. 8 and 9.

Figure 10:
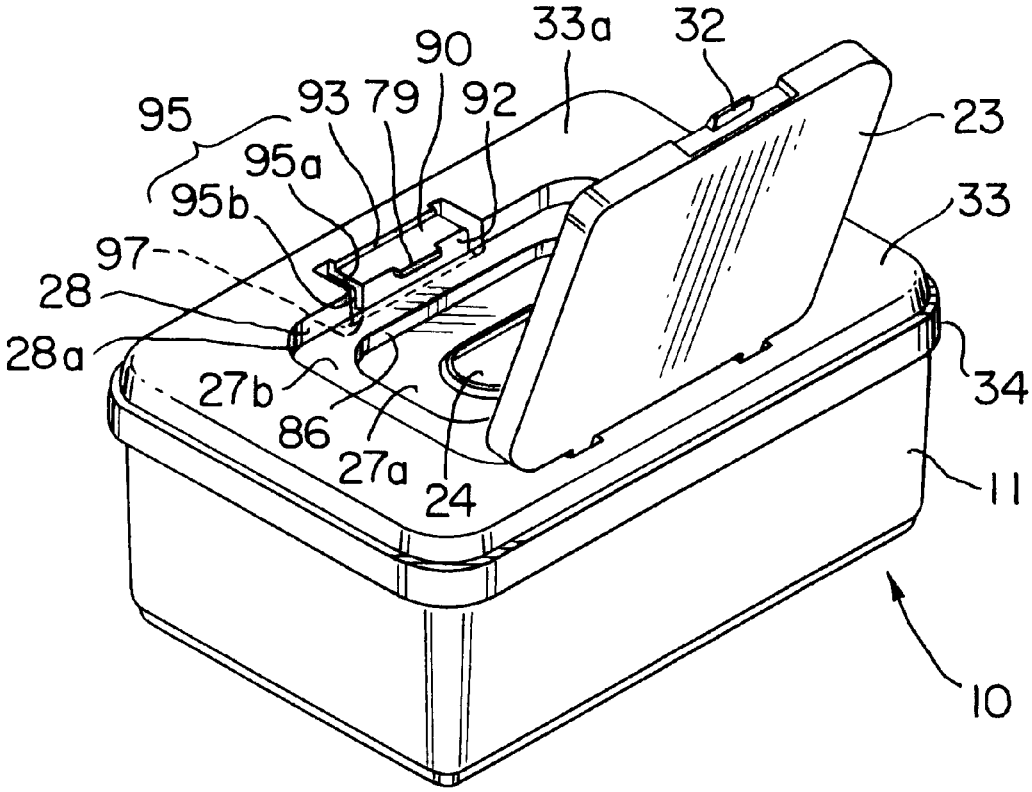
FIG. 10 is a side view of another modification of the present invention.
Figure 11:
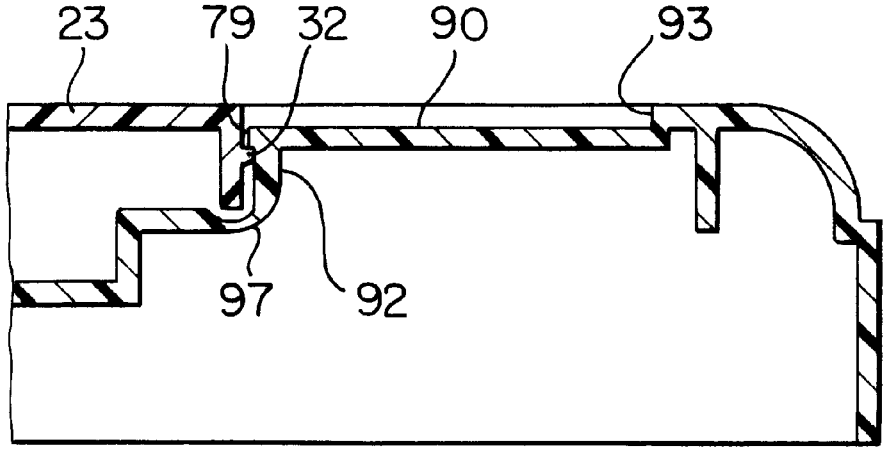
FIG. 11 is a sectional view of the modification shown in FIG. 10.
Figure 12:
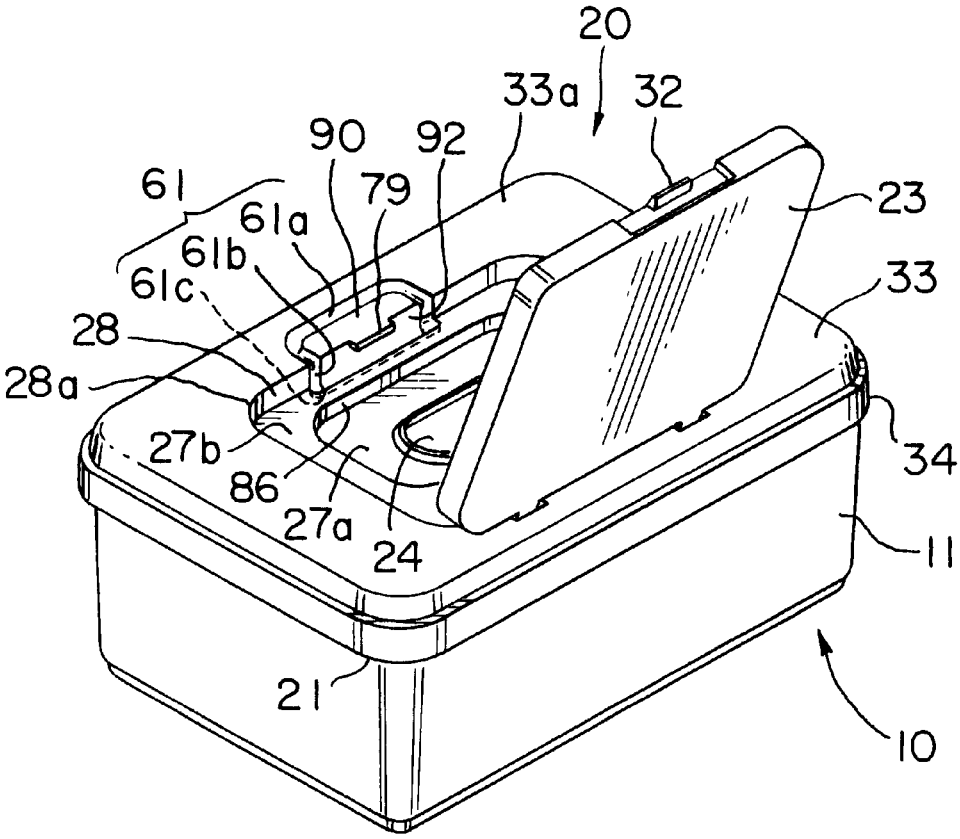
FIG. 12 is a perspective view of a wet tissue container provided with a lid assembly in a third embodiment of the present invention.

As shown in FIGS. 10 and 11, the vertical plate 92 with the thin part 97 at its lower end can easily be bent by pressing the horizontal plate 90.

According to the present invention, the vertical plate connected to the horizontal plate is bent by pressing the horizontal plate, so that the catching projection of the vertical plate is disengaged from the stopping projection on the hinged lid. The hinged lid then opens to allow articles (tissues) in the container body to be pulled out.

Third Embodiment

A third embodiment of the present invention will now described with reference to FIGS. 12 to 15.

Referring to FIGS. 12 to 15, a wet tissue container 10 comprises a container body 11 for containing wet tissues 41 (FIGS. 4(*a*) and 4(*b*)), having an open upper end, and a lid assembly 20 fitted on the container body 11. A flange 12 is formed around the brim of the open end of the container body 11. The flange 12 is fitted in a space surrounded by a rim 34 formed in the lid assembly 20.

The lid assembly 20 has a lid body 21 for hermetically closing the open upper end of the container body 11, and a hinged lid 23 pivotally connected to the lid body 21 by hinge pins 77. The hinge pins 77 are formed integrally with the hinged lid 23 and are fitted in supports, (not shown), formed in the lid body 21 to acts as the hinged lid. (FIG. 14).

The lid body 21 has a first top plate (first thin wall) 27*a* near the central part thereof, a second top plate (second thin plate) 27*b* surrounding the first top plate 27*a* and extended on a level above that of the first top plate 27*a*, a vertical wall 28 surrounding the second top plate 27*b*, and an outer frame 33 extending around the vertical wall 28. Thus, the first top plate 27*a* and the second top plate 27*b* are sunk beneath the outer surface of the outer frame 33 by a depth corresponding to the height of the vertical wall 28. The first top plate 27*a* is provided with a dispensing opening 24 through which the wet tissues 41 are pulled out. The dispensing opening 24 is surrounded by a rim 24*a* having a curved cross section expanding downward. This allows, the wet tissue 41 to be pulled out through the dispensing opening 24 without catching on the rim 24*a* of the dispensing opening 24. A rim 34 which fits over the flange 12 of the container body 11 is formed around the circumference of the outer frame 33.

A rib 85 is formed on the inner surface of the hinged lid 23. The rib 85 fits within the space defined by the vertical wall 86 formed between the first top plate 27*a* and the second top plate 27*b*. The hinged lid 23 is pivoted on the hinge pins 77 so that the rib 85 fits within the space defined by the vertical wall 86, thereby sealing the dispensing opening 24.

Figure 13:
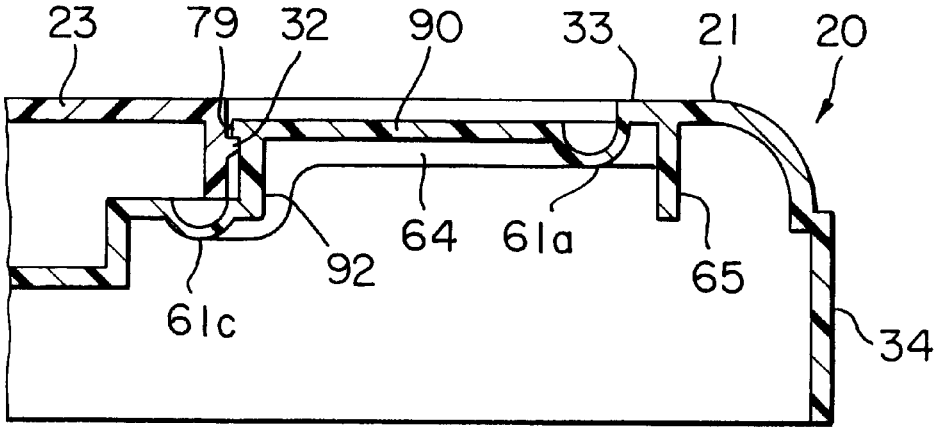
FIG. 13 is an enlarged sectional view of the wet tissue container with its hinged lid closed.
Figure 14:
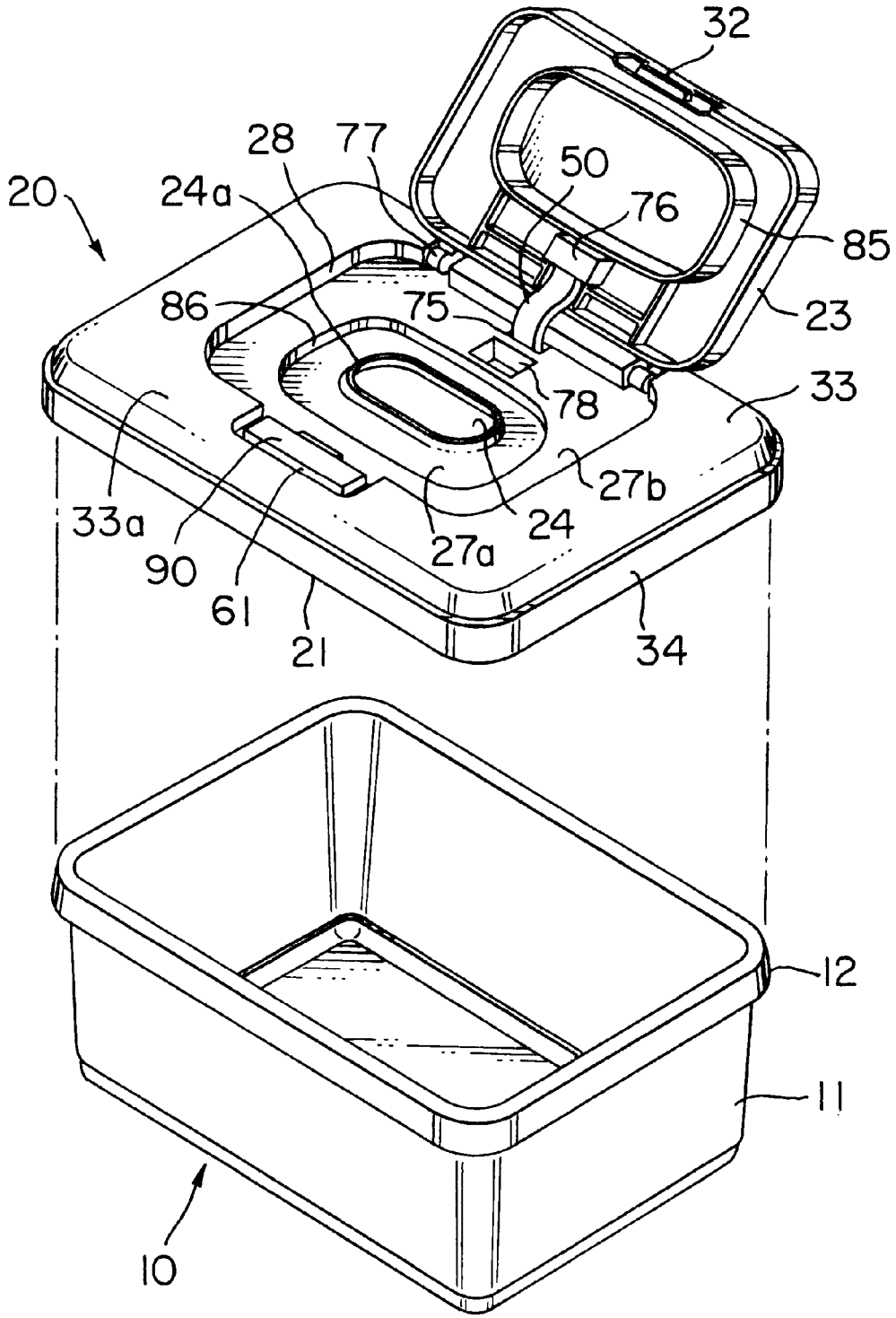
FIG. 14 is a perspective view of a wet tissue container with its hinged lid opened.

As shown in FIGS. 13 and 14, a stopping projection 32 is formed on the free end of the hinged lid 23.

A thin part 61 is formed in the outer frame 33 and the vertical wall 28 of the lid body 21 at a position corresponding to the free end of the hinged lid 23 to form a horizontal plate 90 and a vertical plate 92 separate from other parts 33*a* and 28*a* of the outer frame 33 and the vertical wall 28. The thin part 61 has a U-shaped thin wall 61*a* formed in the outer frame 33, a pair of straight, vertical thin walls 61*b* formed in the vertical wall 28, and a lower thin wall 61*c* formed in a lower end part of the vertical wall 28. The U-shaped thin wall 61*a* separates the horizontal plate 90 from the other part 33*a* of the outer frame 33, and the vertical thin walls 61*b* separate the vertical plate 92 from the other part 28*a* of the vertical wall 28.

The horizontal plate 90 extends from the upper end of the vertical plate 92 in a direction away from the hinged lid 23. A catching projection 79 is provided on the surface of the vertical plate 92 facing the hinged lid 23. This catching projection 79 engages with the stopping projection 32 of the hinged lid 23.

The horizontal plate 90 and the vertical plate 92 are flexible. When the horizontal plate 90 is pressed the vertical plate 92 bends on the lower thin wall 61*c*, thereby disengaging the stopping projection 32 of the hinged lid 23 from the catching projection 79 of the vertical plate 92.

Figure 15:
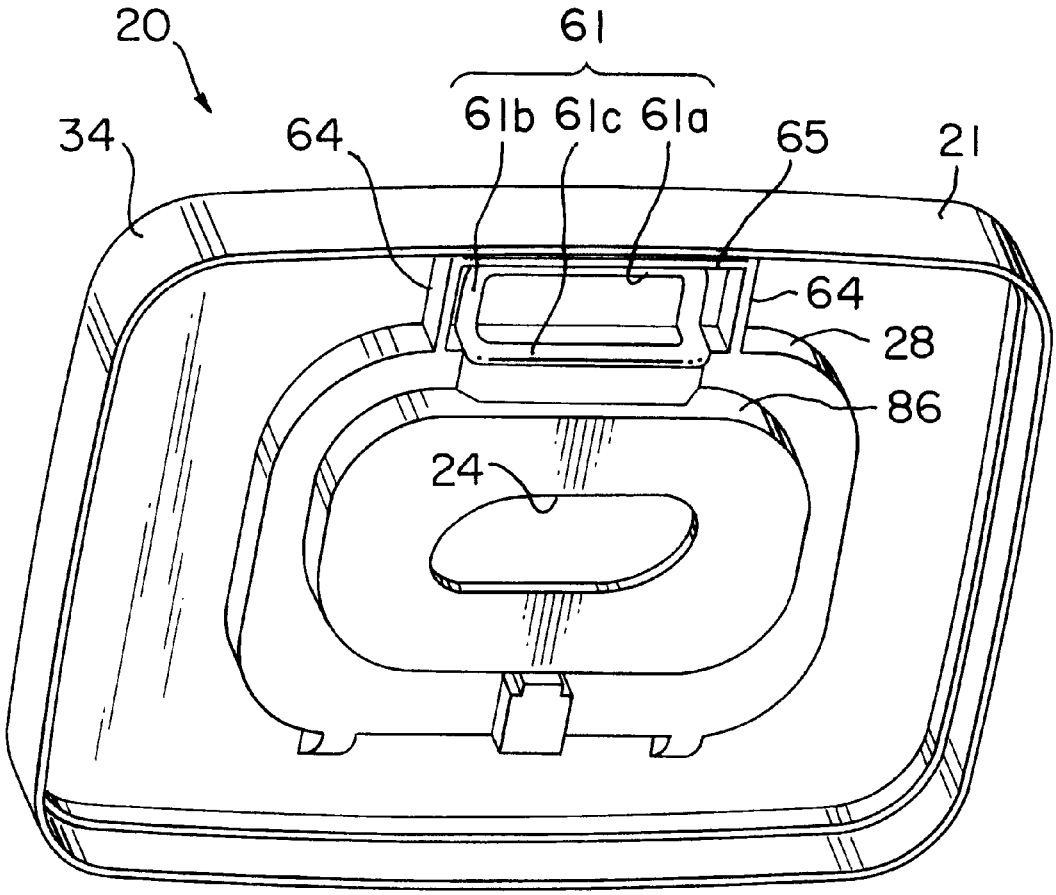
FIG. 15 is a perspective view of a lid body as viewed from inside.

As shown in FIGS. 13 and 15, a pair of ribs 64 are formed on the inner surface of the outer frame 33 of the lid body 21 so as to extend from the vertical wall 28, and are connected to a rib 65. The pair of ribs 64 and the rib 65 surround the thin part 61.

As shown in FIG. 14, an elongated rubber plate 50 for biasing the hinged lid 23 in an opening direction is extended across the axis of the hinge pins 77 which fix the hinged lid 23 to the lid body 21. An opening 75 for receiving one end part of the rubber plate 50 is formed in the lid body 21, and a rubber plate holding part 76 attaching the other end of the rubber plate 50 is formed in a part of the hinged lid 23 at a predetermined distance from the lid body 21.

As shown in FIG. 14, an opening 78 is formed in a part of the lid body 21 near the opening 75 to house the rubber plate 50 that folds when the hinged lid 23 is closed.

When the hinged lid 23 is pushed shut the rubber plate 50 bends away from the pivot pins 77 and exerts a force in an opening direction on the hinged lid 23. At this point, the rubber plate 50 curls up and smoothly fits in the opening 78. This means that, the rubber plate 50 is not pinched between the lid body 21 and the hinged lid 23 or damaged when the hinged lid 23 is closed.

Although the lid assembly 20 shown in FIG. 14 is provided with only the one rubber plate 50, the lid assembly 20 may be provided with a plurality of these.

An operation of the lid assembly in this embodiment will be described below.

One end of the rubber plate 50 is inserted in the opening 75 of the lid body 21, and the other end of the same is fixed to the rubber plate holding part 76 of the hinged lid 23.

A sealed pouch 40 hermetically containing wet tissues 41 is put into the container body 11, and the rim 34 of the lid assembly 20 is fitted over the flange 12 of the container body 11 thereby sealing the upper end of the container body 11. The hinged lid 23 of the lid assembly 20 is then pushed shut on the lid body 21 so that the stopping projection 32 is engaged with the catching projection 79, thereby sealing close the dispensing opening 24 of the lid body 21. In this position, the rubber plate 50 bends away from the common axis of the hinge pins 77 and biases the hinged lid 23 in the opening direction.

Since the rubber plate 50 is fixed to the rubber plate holding part 76 formed at a certain distance from the lid body 21 as shown in FIG. 14, the rubber plate 50 exerts a force on the rubber plate holding part 76 at a short distance inside from the hinge of the hinged lid 23 and this pushes the hinged lid 23 in the opening direction. Generally, the wet tissue container 10 is used in an environment of relatively high temperatures, such as in a room in summer. This use means that the lid body 21 and the hinged lid 23 are liable to be softened, According to the present invention, the turning end of the hinged lid 23 is less likely to be deformed when the point of force of the rubber plate 50 on the hinged lid 23 is at a short distance from the turning end of the hinged lid 23 than when the point of force of the rubber plate 50 is on the turning end of the hinged lid 23.

When using the wet tissues 41, the horizontal plate 90 is depressed to bend the vertical plate 92 connected to the horizontal plate 90 on the lower thin wall 61*c* so that the stopping projection 32 is released from the catching projection 79 without distorting the outer frame 33. Since the horizontal plate 90 and the vertical plate 92 are separated from the other part 33*a* of the outer frame 33 and the vertical wall 28*a* by the thin part 61, and the thin part 61 is surrounded by the pair of ribs 64 and the rib 65, a press applied to the horizontal plate 90 will not be transmitted to the other part 33*a* of the outer frame 33 and the other part 28*a* of the vertical wall 28 when the horizontal plate 90 is pushed to bend the vertical plate 92. Accordingly, the other part 33*a* of the outer frame 33 and the other part 28*a* of the vertical wall 28 do not warp greatly. When the stopping projection 32 is disengaged from the catching projection 79, the hinged lid 23 is turned on the hinge pins 77 by the resilience of the rubber plate 50, thereby opening the hinged lid 23.

The top wet tissue 41 is then pulled out from the container body 11. The lower half 41*b* of the top wet tissue 41 pulls on the upper half 41*a* of the second top wet tissue. As the top wet tissue 41 is pulled further, the upper half 41*a* of the second top wet tissue 41 catches on by the rim 24*a* of the dispensing opening 24 and is separated from the lower half 41*b* of the top wet tissue 41.

In this embodiment, the vertical plate 92 connected to the horizontal plate 90 is bent without greatly warping the other part 33*a* of the outer frame 33 or the other part 28*a* of the vertical wall 28 when pressing the horizontal plate 90, thereby allowing the catching projection 79 of the vertical plate 92 to disengage from the stopping projection 32 on the hinged lid 23 with a high degree of reliability.

According to the present invention, the vertical plate connected to the horizontal plate is bent by depressing the horizontal plate, whereby the catching projection of the vertical plate disengages from the stopping projection on the hinged lid, thereby allowing the hinged lid can to be open and the articles in the container body to be taken out.

What is claimed is:

1. A lid assembly comprising:

a lid body having an outer frame to be fitted on a container body, the lid body being provided with a dispensing opening thereon;

a hinged lid pivotally joined to the lid body so as to close the dispensing opening hermetically; and a hinged joint between the lid body and the hinged lid, provided with an elastic biasing means for biasing the hinged lid in an opening direction; wherein the outer frame is provided in its part on the side of a free end part of the hinged lid with a vertical plate and a horizontal plate;

the hinged lid is provided on its free end part with a stopping projection, the vertical plate is provided with a catching projection that catches the stopping projection of the hinged lid, and the stopping projection can be disengaged from the catching projection by pressing the horizontal plate to bend the vertical plate;

a top plate sunk below an outer surface of the outer frame is connected to the outer frame by a vertical wall, the dispensing opening is formed in the top plate, the horizontal plate and the vertical plate are formed by forming slits in parts of the outer frame and the vertical wall on the side of the free end of the hinged lid, and the horizontal plate and the vertical plate are completely or partially separated from the other parts of the outer frame and the vertical wall by the slits; and the horizontal plate has an outermost end that remains within the periphery of the outer frame.

2. The lid assembly according to claim 1, wherein a recess sunk below an outer surface of the outer frame is formed in a part of the outer frame on the side of the free end part of the hinged lid, the vertical plate is formed in the recess so as to be separated from the outer frame, and the horizontal plate is extended from the vertical plate in a direction away from the hinged lid.

3. The lid assembly according to claim 2, wherein the width of the vertical plate is substantially equal to that of the recess.

4. The lid assembly according to claim 2, wherein the width of the vertical plate is substantially equal to that of a free end part of the hinged lid.

5. The lid assembly according to claim 1, wherein a thin part is provided at a lower end part of the vertical plate for facilitating bending of the vertical plate.

6. The lid assembly according to claim 1, wherein the horizontal plate is completely separate from the other parts of the outer frame.

7. The lid assembly according to claim 6, wherein the horizontal plate is separate completely from the other parts of the outer frame by a U-shaped slit.

8. The lid assembly according to claim 1, wherein the horizontal plate is partly connected to the other parts of the outer frame.

9. The lid assembly according to claim 8, wherein the horizontal plate is separate from the other parts of the outer frame by a pair of linear, horizontal slits, and is connected to the other parts of the outer frame by a linear connecting part.

10. The lid assembly according to claim 1, wherein a top plate sunk below an outer surface of the outer frame is connected to the outer frame by a vertical wall, the dispensing opening is formed in the top plate, the horizontal plate and the vertical plate are formed in thin parts of the outer frame and the vertical wall on the side of a free end of the hinged lid, and the horizontal plate and the vertical plate are separated from the other parts of the outer frame and the vertical wall by the thin parts.

11. The lid assembly according to claim 10, wherein a thin part is provided at a lower end part of the vertical plate for facilitating bending of the vertical plate.

12. The lid assembly according to claim 10, wherein the thin parts comprise a U-shaped thin part formed in the outer frame, and a pair of linear, vertical thin parts formed in the vertical wall.

13. The lid assembly according to claim 10, wherein the outer frame is provided on its inner surface with a reinforcing rib surrounding the thin parts.

* * * * *